US011043343B2

(12) United States Patent
Lehmann et al.

(10) Patent No.: US 11,043,343 B2
(45) Date of Patent: Jun. 22, 2021

(54) ASSEMBLY AND METHOD FOR DAMPING CONTACT BOUNCE IN HIGH-VOLTAGE CIRCUIT BREAKERS

(71) Applicant: SIEMENS AKTIENGESELLSCHAFT, Munich (DE)

(72) Inventors: Volker Lehmann, Treuenbrietzen (DE); Friedrich Loebner, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 16/647,912

(22) PCT Filed: Sep. 10, 2018

(86) PCT No.: PCT/EP2018/074258
§ 371 (c)(1),
(2) Date: Mar. 17, 2020

(87) PCT Pub. No.: WO2019/063271
PCT Pub. Date: Apr. 4, 2019

(65) Prior Publication Data

US 2020/0266015 A1 Aug. 20, 2020

(30) Foreign Application Priority Data

Sep. 27, 2017 (DE) ..... 102017217166

(51) Int. Cl.
*H01H 33/666* (2006.01)
*H01H 33/662* (2006.01)

(52) U.S. Cl.
CPC ..... *H01H 33/666* (2013.01); *H01H 33/66261* (2013.01); *H01H 2033/6665* (2013.01)

(58) Field of Classification Search
CPC .. H01H 33/666; H01H 1/0206; H01H 33/664; H01H 11/04; H01H 1/0015; H01H 1/385; H01H 1/62; H01H 2029/008; H01H 2033/66223; H01H 2033/66253; H01H 2033/6648; H01H 2033/6667; H01H 2036/0086; H01H 2057/006; H01H 2201/022; H01H 2201/03; H01H 2235/01;
(Continued)

(56) References Cited

U.S. PATENT DOCUMENTS 3,705,281 A * 12/1972 Luehring ..... H01B 17/301 218/134
3,740,507 A * 6/1973 Kuhl ..... H01H 33/6645 218/129
(Continued)

FOREIGN PATENT DOCUMENTS

DE 1815722 A1 9/1969
EP 0102317 A2 3/1984
(Continued)

*Primary Examiner* — Truc T Nguyen
(74) *Attorney, Agent, or Firm* — Laurence Greenberg; Werner Stemer; Ralph Locher

(57) ABSTRACT

An assembly and a method for damping contact bounce in high-voltage circuit breakers include a vacuum interrupter and a holder for the vacuum interrupter. The vacuum interrupter includes a housing, at least one movable contact piece and at least one fixed contact piece. At least one mass body is mechanically connected to the at least one fixed contact piece in order to effect damping of the contact bounce between the at least one fixed contact piece and the at least one movable contact piece during a switch-on operation of the high-voltage circuit breaker.

21 Claims, 1 Drawing Sheet

(58) Field of Classification Search
CPC .... H01H 29/004; H01H 33/38; H01H 33/53; H01H 33/662; H01H 33/66207; H01H 33/6643; H01H 33/6661; H01H 33/6662; H01H 33/7023; H01H 33/88; H01H 33/882; H01H 33/90; H01H 33/91; H01H 3/04; H01H 3/06; H01H 3/3005; H01H 3/38; H01H 3/46; H01H 57/00; H01H 59/0009; H01H 9/0027; H01H 9/0038; H01H 9/56
See application file for complete search history.

(56) References Cited

U.S. PATENT DOCUMENTS 4,516,004 A 5/1985 Bany et al.
5,543,598 A * 8/1996 Duffour ..... H01H 33/66238 218/135
6,248,969 B1 * 6/2001 Komuro ..... H01H 33/6643 218/118
6,373,675 B1 * 4/2002 Yamazaki ..... H01H 33/6662 200/237
10,679,807 B2 * 6/2020 Meley ..... H01H 33/66261
2008/0000879 A1 * 1/2008 Steffens ..... H01H 1/62 218/124
2015/0235784 A1 * 8/2015 Karlstrom ..... H01H 1/50 200/48 R
2017/0236663 A1 * 8/2017 Jung ..... H01H 39/002 218/140

FOREIGN PATENT DOCUMENTS

GB 1157015 A 7/1969
JP 2010272445 A 12/2010
JP 2011076758 A 4/2011

* cited by examiner

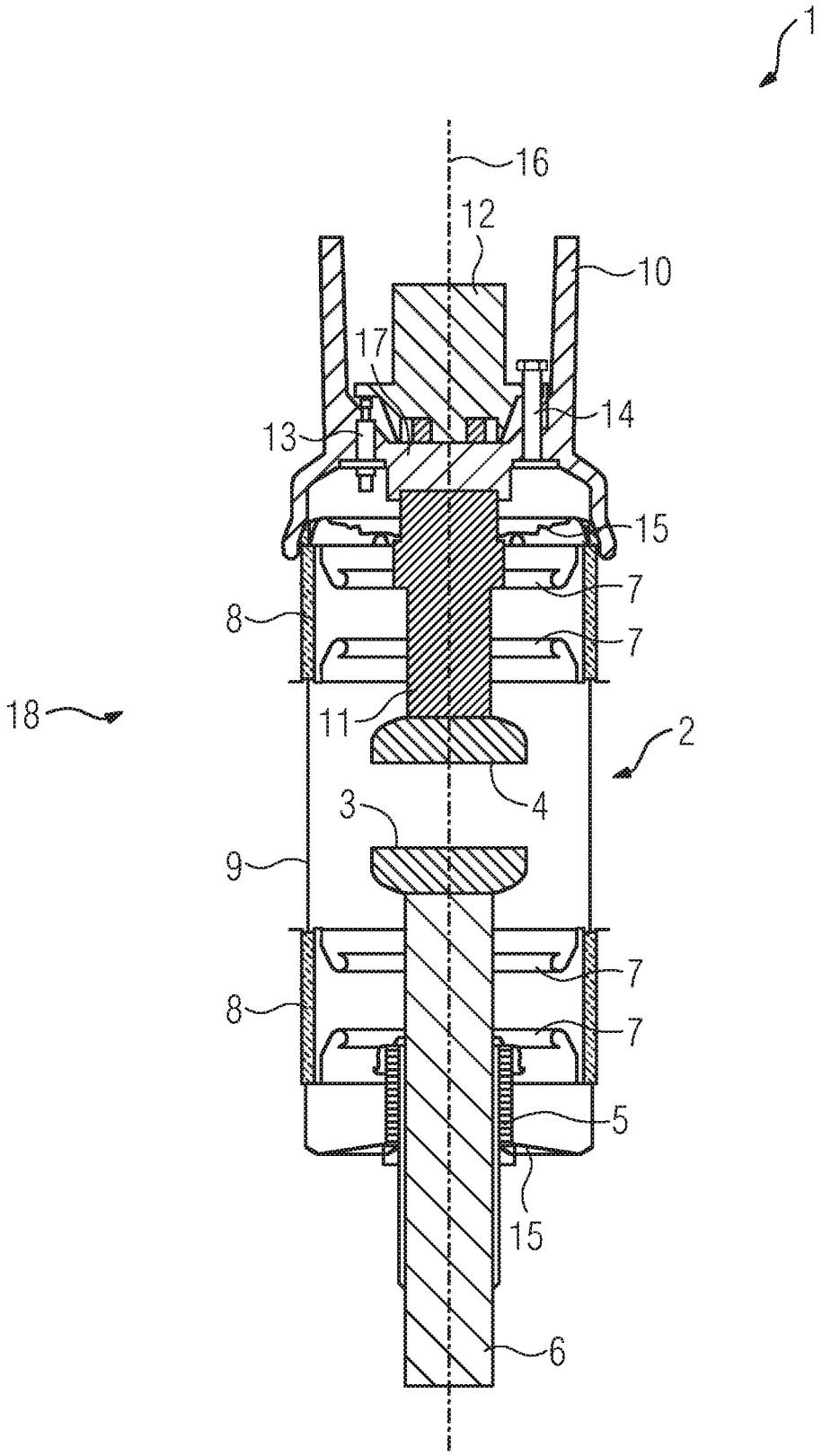
1
16
12
10
17
14
13
15
7
8
7
18
11
2
4
3
9
7
8
7
5
15
6

ASSEMBLY AND METHOD FOR DAMPING CONTACT BOUNCE IN HIGH-VOLTAGE CIRCUIT BREAKERS

BACKGROUND OF THE INVENTION

Field of the Invention

The invention relates to an assembly and a method for damping contact bounce in high-voltage circuit breakers, having a vacuum interrupter and a holder for the vacuum interrupter, wherein the vacuum interrupter comprises a housing, at least one movable contact piece and at least one fixed contact piece.

Vacuum interrupters for high-voltage circuit breakers are known, for example, from EP 0 102 317 A2. The vacuum interrupter comprises a housing in the form of a round, straight cylinder which is evacuated in the interior. The housing is constructed from two identical, straight cylindrical halves composed of ceramic or ceramic parts which are joined together by means of a metal cylinder or by means of a metal part with transition pieces in the middle of the housing. The transition pieces are embodied as shielding electrodes or a shield in the housing. An electrical contact is arranged in the interior of the housing, which electrical contact comprises two contact pieces. One contact piece is fixedly connected to the housing, and the second contact piece is guided through the housing in a movable manner by means of a folding bellows. At the ends, the two contact pieces are respectively embodied in the form of a plate or in the form of a circular cylinder in the interior of the housing, wherein a main or top surface of the cylinders are in contact with one another and are pressed against one another, for good electrical and/or mechanical contact, in the connected state of the contact.

For the purpose of forming a high-voltage circuit breaker, in particular an outdoor high-voltage circuit breaker, the vacuum interrupter is arranged in an insulator which mechanically supports the vacuum interrupter and protects it against external weather influences. Insulators are constructed, for example, from ceramic, silicone and/or composite materials and are of ribbed design on the outer surface, in particular with ribs which run around a cylinder periphery in an annular manner. The ribs improve the electrical insulation along the longitudinal axis on the outer surface of the insulator. An electrical connection for a power line, for example of a power supply system, an electrical load and/or a power generator, is situated at the upper end of the insulator. A second electrical connection for a power line, for example of a power supply system, an electrical load and/or a power generator, is situated at the lower end of the insulator. The current path between the two connections is switched, that is to say connected and/or interrupted, by means of the vacuum interrupter.

The insulator is fastened, for example, on a carrier which is arranged on a base of a high-voltage circuit breaker. In this case, for example, three insulators, each with one or more vacuum interrupters, can be arranged next to one another for the purpose of switching a plurality of poles of a high-voltage circuit breaker. One drive, in particular one stored-energy spring drive, and/or one drive per pole is provided in order to drive the movable contact piece of a vacuum interrupter during switching in each case by means of elements of a kinematic chain. The drive is arranged, for example, on the carrier outside the insulator. The kinetic energy for switching purposes is transmitted from the drive to the movable contact piece of the vacuum interrupter in the insulator, for example, by means of gear elements and/or a switching rod. In this case, high forces have to be applied in order to overcome, in particular, frictional forces in order to accelerate the elements of the kinematic chain, for example, within milliseconds, and in order to accelerate the movable contact piece.

Vacuum interrupters with large dimensions both in respect of physical size and also mass are used for the purpose of switching high voltages, in particular with voltages in the range of up to 1200 kV and/or currents in the region of a few hundred amps.

The contact pieces can have a mass in the region of a few kilograms, which mass has to be accelerated, in particular, within milliseconds in the case of the movable contact piece. The vacuum interrupter is arranged in the insulator, for example an insulator in the form of a hollow tube, in a manner filled with insulating gas, in particular $SF_6$, and is spatially fixed or fastened, for example, by means of a suspension assembly or holder at the upper end of the insulator. The fixed contact piece of the vacuum interrupter is arranged toward the upper side of the insulator and the movable contact piece of the vacuum interrupter is arranged toward the lower side of the insulator. The movable contact piece is driven by means of, in particular, a switching rod, for example mounted by means of sealing elements of the insulator and/or a folding bellows of the vacuum interrupter.

During a switch-on operation of the vacuum interrupter, the movable contact piece strikes or hits the fixed contact piece. In the process, kinetic energy or a pulse is transmitted from the movable contact piece to the fixed contact piece. Large pulses are transmitted in the case of a high mass of the movable contact piece, in particular in the region of kilograms, and high speeds, in particular during switching over large switching distances between the contact pieces in the disconnected state and in particular in the case of high switching voltages with switching times in the millisecond range. The fixed contact piece is held or fixed in a spatially fixed manner on the housing of the vacuum interrupter, for example, by means of a metal sheet which is pushed outward by a large pulse and rebounds. In the process, the fixed contact piece performs a kind of oscillating movement, wherein contact bounce is produced. The movable contact piece bounces against the fixed contact piece and transmits a portion of its pulse. The fixed contact piece swings out and back along the longitudinal axis of the vacuum interrupter, and bounces back onto the movable contact piece which is pressed, for example, by means of a spring back in the direction of the fixed contact piece again.

This creates a movement of the contact pieces, with one contact piece respectively bouncing against the other contact piece, and pulse transmission, wherein the other contact piece is accelerated away from the first contact piece and a gap is created between the contact pieces. The second contact piece is then braked by a restoring force, for example, by means of a spring in the case of a movable contact piece or by the metal sheet, to which it is fastened, in the case of the fixed contact piece, and accelerated toward the opposite contact piece in the opposite direction. The contact pieces collide and the movement is created once again only in the opposite direction. Contact bounce which is associated with the movement of the contact pieces, in the case of which the contact pieces come into mechanical contact, in particular periodically, and then a gap is created again until the kinetic energy is, for example, completely converted into heat during the damped movement, involves an arc burning between the contact pieces in the gap with high voltage connected.

The longer the contact bounce lasts, the greater are the arc burning periods and the associated erosion on the contact pieces and also the heating of the contact pieces by the arc. High temperatures of the contact pieces may result in the contact pieces becoming stuck or welded, and this can lead to failure of the vacuum interrupter. Optimization of the kinematic chain, for example by means of gear elements and/or adjusting the mass of the elements of the kinematic chain, can reduce contact bounce. Optimization of this kind is complicated, costly and can lead to a change in or an adverse effect on switching properties, for example an extension of the switching times, and/or to an increase in the kinetic energy of the high-voltage circuit breaker that is required for switching. As a result, a drive of large dimensions may be necessary, and this involves additional costs and additional complexity.

SUMMARY OF THE INVENTION

The object of the present invention is to specify an assembly for a high-voltage circuit breaker and a method for damping contact bounce in high-voltage circuit breakers, which assembly and method solve the problems described above. A particular object is to reduce or to suppress contact bounce of the contact pieces of the vacuum interrupter and/or to increase the service life or reliability of a high-voltage circuit breaker having a vacuum interrupter in a simple and cost-effective manner.

According to the invention, the specified object is achieved by an assembly for a high-voltage circuit breaker having the features recited below and/or by a method for damping contact bounce in high-voltage circuit breakers, in particular in the assembly described above, having the steps recited below. Advantageous refinements of the assembly according to the invention for a high-voltage circuit breaker and/or of the method for damping contact bounce in high-voltage circuit breakers, in particular in the assembly described above, are specified in the dependent claims. In this case, subjects of the main claims can be combined with one another and with features of dependent claims, and features of the dependent claims can also be combined with one another.

An assembly according to the invention for a high-voltage circuit breaker comprises a vacuum interrupter and a holder for the vacuum interrupter. The vacuum interrupter comprises a housing, at least one movable contact piece and at least one fixed contact piece. In this case, at least one mass body is mechanically connected to the at least one fixed contact piece in order to effect damping of contact bounce between the at least one fixed contact piece and the at least one movable contact piece during a switch-on operation of the high-voltage circuit breaker.

The mass body allows contact bounce to be reduced or to be entirely prevented. The pulse, which is transmitted from the movable contact piece to the fixed contact piece, can be absorbed by the mass body and therefore kinetic energy can be drawn from the fixed contact piece. As a result, the fixed contact piece swings back only with little kinetic energy and does not bounce against the movable contact piece. Rather, said fixed contact piece can approach the movable contact piece with little kinetic energy until the contact pieces make, in particular gentle, mechanical and electrical contact, wherein the movable contact piece receives substantially no pulse transmission and is not moved away from the fixed contact piece. Contact bounce is suppressed.

Optimization of the movements of the contact pieces for damping contact bounce is performed by means of the mass body, as a result of which complicated, costly optimization of the movement by means of elements of the kinematic chain does not have to be performed. This saves costs and complexity and leads to a simple, cost-effective design of the assembly according to the invention. By virtue of reducing to completely suppressing contact bounce, the arc burning period and therefore the erosion on the contact pieces are reduced, and the service life of the vacuum interrupter and, respectively, of the assembly is increased.

The mass body can be mechanically connected to the holder, in particular arranged in the holder. This provides a simple design with stable, durable holding of the mass body, in particular in a space-saving manner in the holder of the vacuum interrupter.

The vacuum interrupter can be suspended from the holder. As a result, the vacuum interrupter can be spatially fixed, for example arranged in an insulator, in a simple and cost-effective manner with long-term stability. Pulses which are transmitted to the vacuum interrupter by the movement of the movable contact piece, in a manner generated by a drive and transmitted by means of elements of a kinematic chain, can be compensated or absorbed by means of the holder and, for example, by means of an outer, in particular solid, insulator.

The holder can be of tubular design, with an intermediate floor through which the fixed contact piece is guided by means of a connecting element and/or on which the at least one mass body is mounted. This provides a simple, cost-effective design, wherein the mass body is mounted with long-term stability.

The at least one fixed contact piece can have substantially the same mass as the at least one mass body. As a result, the pulse of the fixed contact piece, after the collision with the movable contact piece, can be completely absorbed by the mass body, without the fixed contact piece bouncing back onto the movable contact piece. As a result, the bounce behavior of the contact pieces can be optimized in a simple and cost-effective manner, independently of the kinematic chain and of the drive.

At least one damping element can be comprised, in particular between the holder and the at least one mass body, in particular in the form of a spring and/or a hydraulic damper. The pulse of the movement of the fixed contact piece, transmitted onto the mass body, can be completely absorbed by means of the damping element and converted, for example, into heat. As a result, there is no return transmission of the pulse of the mass body back onto the fixed contact piece and contact bounce, in particular with the fixed contact piece bouncing back onto the movable contact piece, can be completely suppressed in a simple and cost-effective manner.

At least one guide can be comprised, for the purpose of guiding a movement of the at least one mass body and/or for spatially fixing the at least one mass body along a longitudinal axis, in particular at least one guide which is fastened to the holder. As a result, a pulse of the fixed contact piece can be readily absorbed by the mass body, in particular by guided movement of the mass body, and transmitted, for example, onto a damping element, wherein the mass body returns to its starting position again through the guide. Destruction, in particular of the holder, or an irreversible change in the position of the mass body are prevented, and the assembly according to the invention is formed with a simple and cost-effective design with long-term stability.

The at least one mass body can be of solid design and/or formed from one piece, in particular can be of substantially cylindrical design. As a result, interlocking, space-saving assembly of the mass body can be performed, in particular in the case of a cylindrical vacuum interrupter and/or cylindrical contact pieces and/or a cylindrical holder and/or in particular a cylindrical outer insulator. A solid design of the mass body in one piece leads to a compact mass body with long-term stability which is highly suitable for absorbing large pulses.

The at least one mass body can have a weight in the region of a few kilograms. As a result, large pulses can be absorbed by the mass body. Good optimization of the bounce behavior can be performed with the mass body, with good damping and/or suppression of contact bounce, in the case of a fixed contact piece with a mass in the region of a few kilograms.

The at least one mass body can be composed of a metal, in particular steel, lead or copper. The at least one mass body can comprise a metal, in particular steel, copper, lead and/or alloys of these or other materials. As a result, a large mass with a compact form of the mass body can be achieved, with high mechanical long-term stability of the mass body.

A method according to the invention for damping contact bounce in high-voltage circuit breakers, in particular in an assembly as described above, comprises the movement of at least one movable contact piece when a vacuum interrupter is switched on, which movable contact piece strikes at least one fixed contact piece with a pulse, wherein the pulse is transmitted to at least one mass body. As a result, contact bounce is partially or completely damped, in particular with damping in accordance with the aperiodic limiting case.

A movement of the at least one mass body can be damped in the direction of the at least one fixed contact piece by a damping element, in particular by a damping element fastened to a holder of the vacuum interrupter.

A movement of the at least one mass body, in particular with a mass of the at least one mass body in the region of the mass of the at least one fixed contact piece, can effect complete absorption of the pulse which, when the at least one movable contact piece strikes the at least one fixed contact piece, is transmitted when the vacuum interrupter is switched on.

The advantages of the method according to the invention for damping contact bounce in high-voltage circuit breakers, in particular in an assembly as described above, are analogous to the above-described advantages of the assembly according to the invention for a high-voltage circuit breaker, and vice versa.

In the following, an exemplary embodiment of the invention is schematically illustrated in the single FIGURE and described in more detail below.

BRIEF DESCRIPTION OF THE SINGLE VIEW OF THE DRAWING

The FIGURE schematically shows a sectional view through an assembly 1 according to the invention for a high-voltage circuit breaker, having a vacuum interrupter 18 and having a mass body 12 which effects damping of contact bounce between a fixed contact piece 4 and a movable contact piece 3 of the vacuum interrupter 18 during a switch-on operation.

DETAILED DESCRIPTION OF THE INVENTION

FIG. 1 schematically illustrates a sectional view through an assembly 1 according to the invention for a high-voltage circuit breaker. The assembly 1 according to the invention comprises a vacuum interrupter 18 and a holder 10 for the vacuum interrupter 18 and also a mass body 12. The vacuum interrupter 18 has a housing 2, at least one movable contact piece 3 and at least one fixed contact piece 4. The vacuum interrupter 18 is fastened to the holder 10, in particular suspended so as to point away from the holder 10 in the downward direction, on the side of the fixed contact piece 4. The mass body 12 is arranged in the holder 10 and is in mechanical contact, in particular in direct mechanical contact, with the fixed contact piece 4.

The housing 2 of the vacuum interrupter 18 comprises two hollow-cylindrical, that is to say tubular, ceramic parts 8 which are connected to one another by means of a hollow-cylindrical, that is to say tubular, metal part 9. The housing parts can be connected, for example, by soldering, welding and/or adhesive bonding. The ceramic parts 8 and the metal part 9 have substantially the same diameter, wherein the metal part 9 comprises, at its ends, bent annular shields 7, in each case extended into the inner diameter of the ceramic parts 8. At the upper and the lower end of the vacuum interrupter 18, the ceramic parts 8 are each sealed in a vacuum-tight manner by means of closure caps 15, for example composed of circular or hat-like sheet metal. The closure caps 15 each have annular shields 7 which are bent at the outer circumference of said closure caps and which point into the inner diameter of the ceramic parts 8 and are arranged opposite the shields 7 of the metal part 9. The shields 7 and the metal part 9 shield electromagnetic fields of the contact pieces 3, 4 to the outside and protect the ceramic parts 8 against particles which are created, for example, by arcs between the contact pieces 3, 4 during switching or due to erosion of the contact pieces 3, 4.

The movable contact piece 3 is guided in a vacuum-tight manner by means of a folding bellows 5 in a movable manner through the lower closure cap 15 of the housing 2 of the vacuum interrupter 18. The movable contact piece 3 can be moved during switching, that is to say can be moved in a manner accelerated in the direction of the fixed contact piece 4 during switch-on and can be moved in a manner accelerated away from the fixed contact piece 4 during switch-off, in particular by means of a switching rod 6 and further elements, not shown in the FIGURE for reasons of simplicity, of the kinematic chain. The kinetic energy for the movement is provided, for example, by a drive, in particular a stored-energy spring drive. Movements with large forces, large accelerations and a large pulse for switching times in the millisecond range can therefore be generated and transmitted to the movable contact piece 3.

In the upper region of the vacuum interrupter 18, the fixed contact piece 4 is connected to the upper closure cap 15 by way of a connecting element 11 with mechanical stability and guided through the upper closure cap 15 of the housing 2 of the vacuum interrupter 18 in a vacuum-tight manner. The closure caps 15 are, for example, composed of a metal sheet, in particular a steel sheet, which has, for example, a thickness in the region of a few millimeters or less. In the event of movements of the fixed contact piece 4, wherein fixed is used in the sense of fixed in a mechanically stable manner or fastened to the closure cap 15 in the following, the metal sheet of the closure cap 15 can be bent, as a result of which the fixed contact piece 4 moves to a slight extent. Analogously to a spring, a restoring force acts in such a way that the metal sheet deforms back to its initial shape, as a result of which the fixed contact piece 4 moves back. Movements of the contact pieces 3 and 4 take place substantially along a center axis 16 of the assembly 1 or of the vacuum interrupter 18. As an alternative, the metal sheet of the closure cap 15 can be of mechanically stable, rigid design, wherein the fixed contact piece 4 is connected to the closure cap 15 in a non-movable manner, in particular by means of the connecting element 11. Pulse transmission from the fixed contact piece 4 to the mass body 12 is then performed without a movement of the fixed contact piece 4, in particular by means of the connecting element 11 on the movably mounted mass body 12, in particular without a spring action of the closure cap 15 or without bending of the closure cap 15.

The holder 10, on/to which the vacuum interrupter 18 is arranged and/or fastened, that is to say is suspended as in the exemplary embodiment of the FIGURE for example, is of cylindrical design, in particular in the form of a hollow tube with an intermediate floor 17 in the interior of the holder 10. The holder 10 can be designed, for example, analogously to a hat with a brim, wherein the vacuum interrupter 18 is fastened in a mechanically stable manner to the brim in particular. The fixed contact piece 4 comprises a connecting element 11 which is of, for example, cylindrical or bolt-like design. The connecting element 11 is fastened, for example welded or soldered, in a vacuum-tight manner to the upper closure cap 15 of the vacuum interrupter 18 in a mechanically stable manner, and runs through the, in particular metal sheet-like, upper closure cap 15. A plate-like electrical contact piece 4 or an electrode is formed at one end of the connecting element 11 in the interior of the vacuum interrupter 18. A plate-like electrical contact piece 3 or a second electrode is formed at one end, for example, of an electrically conductive switching rod 6, which is comprised by the movable contact piece 3, parallel and opposite to said plate-like electrical contact piece 4 or electrode in the interior of the vacuum interrupter 18.

Outside the vacuum interrupter 18, the mass body 12 is arranged so as to be, in particular, in direct mechanical contact with the connecting element 11 at the other end of the connecting element 11. The connecting element 11 is guided in a movable manner through an opening in the intermediate floor 17, in particular a round opening, and can be held, for example, by lateral union nuts above the opening. The mass body 12 is arranged above the connecting element 11, at its end on the intermediate floor 17 of the holder 10, in the interior of the, in particular tubular, holder 10. The mass body 12 is, in particular, of cylindrical or hat-like design, for example is designed in an interlocking manner with the inner diameter of the holder 10, and rests in a mechanically stable manner, in particular owing to its weight force, on the end of the connecting element 11 and the intermediate floor 17.

At least one guide 14 is, in particular laterally, arranged on the mass body 12, for example in the form of a bolt which is anchored, in particular screwed or welded, in the intermediate floor 17 and which is guided through the mass body 12 through a bore. A plurality of, in particular three, guides 14 can be arranged at regular distances from one another, for example, in the region of the outer periphery of the mass body 12 in order to prevent jamming during movements of the mass body 12. In particular, at least one damping element is laterally arranged on the mass body 12, for example in the form of a hydraulic damper which is anchored, in particular screwed or welded, in the intermediate base 17 and which acts from below, in particular, on a brim of the mass body 12 and/or is mechanically connected, for example screwed or welded, to the mass body 12. A plurality of, in particular three, dampers 13 can be arranged at regular distances from one another, in particular offset in relation to the guides 14, for example, in the region of the outer periphery of the mass body 12 in order to render possible uniform damping of the movement of the mass body 12 in the direction of the intermediate floor 17.

When the high-voltage circuit breaker, that is to say the vacuum interrupter 18, is switched on, the movable contact piece 3 is moved in the direction of the fixed contact piece 4 until the gap between the two contact pieces 3 and 4 is closed and the movable contact piece 3 is in mechanical and electrical contact with the fixed contact piece 4. The movable contact piece 3 moves along the center axis 16, in particular in a sharply accelerated manner at the start and at high speeds in order to render possible switching in the millisecond range. During switch-on at a high-speed, the movable contact piece 3 hits the fixed contact piece 4 and transmits a large pulse onto the fixed contact piece 4. As a result, the fixed contact piece 4 which is fixedly fastened to the upper closure cap 15 of the vacuum interrupter 18 is moved. The movement takes place away from the moved contact piece 3 along the center axis 16, wherein the metal sheet of the upper closure cap 15 curves outward. The pulse of the fixed contact piece 4 is transmitted to the mass body 12, that is to say the mass body 12 is moved away from the movable contact piece 3 along the center axis 16 together with the fixed contact piece 4. In the process, the guide 14 secures the movement of the mass body 12 along the center axis 16.

A restoring force by the upper closure cap 15, which acts analogously to a leaf spring, leads to a movement of the fixed contact piece 4 back in the direction of the movable contact piece 3. As an alternative or in addition, the weight force of the mass body 12 can lead to a movement of the fixed contact piece 4 back in the direction of the movable contact piece 3. In this case, the pulse from the movable contact piece 3, in a manner transmitted to the fixed contact piece 4 and further to the mass body 12, is absorbed by the mass body 12 and a return movement of the mass body 12 and of the fixed contact piece 4 in the direction of the movable contact piece 3 takes place in manner braked by the damping element or elements 13. The movement of the fixed contact piece 4 in comparison to the initial movement of the movable contact piece 3 is small and takes place over a small distance, for example in the region of millimeters, until the fixed contact piece 4 is in mechanical and electrical contact with the movable contact piece 3. Owing to the small travel or distance, the slow, braked movement of the fixed contact piece 4 in the direction of the movable contact piece 3 does not cause a great switching delay or long arc burning. The movement takes place only briefly owing to the small travel. Large pulse transmission and movement of the movable contact piece 3 by the moved-back fixed contact piece 4 substantially does not take place owing to the pulse absorption by the mass body 12 and, in particular, owing to the braked return movement of the fixed contact piece 4 by the damping elements 13.

The movable contact piece 3 is held in its contact position with the fixed contact piece 4 and pressed against the fixed contact piece 4, for example, by a spring which is not illustrated in the FIGURE for reasons of simplicity. The fixed contact piece 4 is held in its contact position with the movable contact piece 3 and pressed against the movable contact piece 3 by the restoring force of the upper closure cap 15 and/or the weight force of the mass body 12. As a result, good mechanical and electrical contact of the movable contact piece 3 with the fixed contact piece 4 is provided in the switched-on state of the high-voltage circuit breaker, that is to say the vacuum interrupter 18. Contact bounce with the contact pieces 3, 4 mutually bouncing against one another several times and with pulse transmissions to one another does not take place since, after the said contact pieces first bounce against one another and pulse transmission takes place from the movable contact piece 3 to the rebounding fixed contact piece 4, the pulse of the movement is absorbed by the mass body 12 and is transmitted, in particular, to the damping elements 13.

As a result, a long burning period of an arc between the contact pieces 3 and 4 is avoided during switch-on, and there is little erosion of the contact pieces 3 and 4, this being associated with little wear of the contact pieces 3 and 4, and welding of the contact pieces 3 and 4 can be avoided. The service life of the contact pieces 3 and 4 and therefore of the high-voltage circuit breaker, that is to say of the vacuum interrupter 18, is increased and functioning with long-term stability is ensured. Complicated, costly optimization of the drive and/or of the kinematic chain for preventing or minimizing contact bounce is not necessary since simple and cost-effective optimization can be performed by the mass body 12. In particular, a mass body 12 with substantially the same mass as the mass of the fixed contact piece 4 and/or movable contact piece 3 can provide optimum absorption of the pulse of the switch-on movement with minimal contact bounce and/or a minimal arc burning period.

The above-described exemplary embodiments can be combined with one another and/or can be combined with the prior art. Therefore, for example, springs can be used instead of hydraulic damping elements 13, which springs produce, for example, a contact pressure by the fixed contact piece 3 on the movable contact piece 4 in the switched-on state. The mass body 12, elements of the holder 10 and/or shields 7 and/or the metal part 9 and also the folding bellows 5, the closure cap 15, the connecting element 11, the switching rod 6 and the movable and/or fixed contact piece 3, 4, can be composed of steel and/or copper for example. The opposite surfaces of the contact pieces 3, 4, that is to say the contact areas, can be coated against erosion and/or can be slotted in order to push an arc through electrical fields outward in a targeted manner and to extinguish said arc. The fixed contact piece 4 can be movably mounted in the upper closure cap 15 by means of a folding bellows, wherein a restoring force in the direction of the movable contact piece 3 is not generated by a spring action of the closure cap 15, but rather, for example, by the weight of the mass body 12 and/or, for example, springs as damping elements 13.

LIST OF REFERENCE SYMBOLS

1 Assembly having a vacuum interrupter
2 Housing
3 Movable contact piece
4 Fixed contact piece
5 Folding bellows
6 Switching rod
7 Shield
8 Ceramic part
9 Metal part
10 Holder
11 Connecting element, in particular bolt
12 Mass body
13 Damping element
14 Guide
15 Closure cap
16 Center axis
17 Intermediate floor
18 Vacuum interrupter

The invention claimed is:

1. An assembly for a high-voltage circuit breaker, the assembly comprising:
- a vacuum interrupter including a housing, at least one movable contact piece and at least one fixed contact piece;
- a holder for said vacuum interrupter, said holder having a tubular shape and an intermediate floor;
- a connecting element guiding said fixed contact piece through said intermediate floor; and
- at least one mass body mechanically connected to said at least one fixed contact piece to effect damping of contact bounce between said at least one fixed contact piece and said at least one movable contact piece during a switch-on operation of the high-voltage circuit breaker.

2. The assembly according to claim 1, wherein said at least one mass body is mechanically connected to or disposed in said holder.

3. The assembly according to claim 1, wherein said vacuum interrupter is suspended from said holder.

4. An assembly for a high-voltage circuit breaker, the assembly comprising:
- a vacuum interrupter including a housing, at least one movable contact piece and at least one fixed contact piece;
- a holder for said vacuum interrupter, said holder having a tubular shape and an intermediate floor; and
- at least one mass body mechanically connected to said at least one fixed contact piece to effect damping of contact bounce between said at least one fixed contact piece and said at least one movable contact piece during a switch-on operation of the high-voltage circuit breaker, said at least one mass body being mounted on said intermediate floor.

5. The assembly according to claim 1, wherein said at least one fixed contact piece and said at least one mass body have identical masses.

6. The assembly according to claim 1, which further comprises at least one damping element disposed between said holder and said at least one mass body.

7. The assembly according to claim 6, wherein said at least one damping element is at least one of a spring or a hydraulic damper.

8. An assembly for a high-voltage circuit breaker, the assembly comprising:
- a vacuum interrupter including a housing, at least one movable contact piece and at least one fixed contact piece;
- a holder for said vacuum interrupter;
- at least one mass body mechanically connected to said at least one fixed contact piece to effect damping of contact bounce between said at least one fixed contact piece and said at least one movable contact piece during a switch-on operation of the high-voltage circuit breaker; and
- at least one guide for at least one of guiding a movement of said at least one mass body or spatially fixing said at least one mass body along a longitudinal axis.

9. The assembly according to claim 8, wherein said at least one guide is fastened to said holder.

10. The assembly according to claim 1, wherein said at least one mass body is at least one of solid or formed in one piece or cylindrical.

11. The assembly according to claim 1, wherein said at least one mass body has a weight in a range of several kilograms.

12. The assembly according to claim 1, wherein said at least one mass body is composed of a metal or includes a metal.

13. The assembly according to claim 1, wherein said at least one mass body is composed of steel, lead or copper or includes alloys of steel, lead or copper.

14. A method for damping contact bounce in high-voltage circuit breakers, the method comprising the following steps:

providing an assembly including a vacuum interrupter having a housing, at least one movable contact piece and at least one fixed contact piece, and at least one mass body mechanically connected to the at least one fixed contact piece;

providing a holder for the vacuum interrupter, the holder having a tubular shape and an intermediate floor;

using a connecting element to guide the fixed contact piece through the intermediate floor;

moving the at least one movable contact piece when switching on the vacuum interrupter, causing the at least one movable contact piece to strike the at least one fixed contact piece with a pulse; and transmitting the pulse to the at least one mass body, causing a contact bounce to be partially or completely damped.

15. The method according to claim 14, which further comprises damping the contact bounce with an aperiodic limiting case.

16. The method according to claim 14, which further comprises using a damping element to damp a movement of the at least one mass body in a direction of the at least one fixed contact piece.

17. The method according to claim 16, which further comprises fastening the damping element to a holder of the vacuum interrupter.

18. The method according to claim 14, which further comprises using a movement of the at least one mass body to effect complete absorption of the pulse which is transmitted when the vacuum interrupter is switched on and the at least one movable contact piece strikes the at least one fixed contact piece.

19. The method according to claim 18, which further comprises selecting a mass of the at least one mass body to be in a region of a mass of the at least one fixed contact piece.

20. A method for damping contact bounce in high-voltage circuit breakers, the method comprising the following steps:

providing an assembly including a vacuum interrupter having a housing, at least one movable contact piece and at least one fixed contact piece, and at least one mass body mechanically connected to the at least one fixed contact piece;

providing a holder for the vacuum interrupter, the holder having a tubular shape and an intermediate floor;

mounting the at least one mass body on the intermediate floor;

moving the at least one movable contact piece when switching on the vacuum interrupter, causing the at least one movable contact piece to strike the at least one fixed contact piece with a pulse; and transmitting the pulse to the at least one mass body, causing a contact bounce to be partially or completely damped.

21. A method for damping contact bounce in high-voltage circuit breakers, the method comprising the following steps:

providing an assembly including a vacuum interrupter having a housing, at least one movable contact piece and at least one fixed contact piece, at least one mass body mechanically connected to the at least one fixed contact piece, and a holder for the vacuum interrupter;

using at least one guide for at least one of guiding a movement of the at least one mass body or spatially fixing the at least one mass body along a longitudinal axis;

moving the at least one movable contact piece when switching on the vacuum interrupter, causing the at least one movable contact piece to strike the at least one fixed contact piece with a pulse; and transmitting the pulse to the at least one mass body, causing a contact bounce to be partially or completely damped.

* * * * *